US007891541B2

(12) United States Patent
Mittelstaedt

(10) Patent No.: US 7,891,541 B2
(45) Date of Patent: Feb. 22, 2011

(54) STORAGE CONTAINER

(76) Inventor: Chris Mittelstaedt, 405 Victory Dr., Suite D, South San Francisco, CA (US) 94080

( * ) Notice: Subject to any disclaimer, the term of this patent is extended or adjusted under 35 U.S.C. 154(b) by 0 days.

(21) Appl. No.: 12/079,790

(22) Filed: Mar. 27, 2008

(65) Prior Publication Data

US 2008/0237325 A1 Oct. 2, 2008

(51) Int. Cl.
*B65D 5/42* (2006.01)
*B65D 5/468* (2006.01)

(52) U.S. Cl. ..... 229/117.16; 229/149; 229/163; 229/177; 229/178

(58) Field of Classification Search ..... 229/117.13, 229/117.14, 117.16, 117.17, 148, 149, 150, 229/163, 172, 177, 178, 915, 919
See application file for complete search history.

(56) References Cited

U.S. PATENT DOCUMENTS 2,989,223 A * 6/1961 Magazzu ..... 229/143
3,140,812 A * 7/1964 Hall et al. ..... 229/117.13
3,240,418 A * 3/1966 Elias ..... 229/126
3,291,370 A * 12/1966 Elias ..... 229/143
3,310,219 A * 3/1967 Dlugopolski ..... 229/152
3,313,468 A * 4/1967 Ross ..... 229/126
3,871,570 A * 3/1975 Garmon ..... 229/915
3,924,801 A * 12/1975 Partain ..... 229/178
3,986,657 A * 10/1976 Angelini ..... 229/163
4,674,676 A * 6/1987 Sandel et al. ..... 229/150
5,018,663 A * 5/1991 Corso ..... 229/117.13
5,392,985 A * 2/1995 Smith et al. ..... 229/149
5,553,772 A * 9/1996 Jensen ..... 229/148
6,736,309 B1 * 5/2004 Westerman et al. ..... 229/149
7,628,312 B2 * 12/2009 Mittelstaedt et al. ..... 229/149
7,673,787 B2 * 3/2010 Mittelstaedt ..... 229/163

FOREIGN PATENT DOCUMENTS

DE 3644145 A1 * 12/1987 ..... 229/152

* cited by examiner

*Primary Examiner*—Gary E Elkins
(74) *Attorney, Agent, or Firm*—Wiesner & Associates; Leland Wiesner

(57) ABSTRACT

Featured is a storage container having a rectangular base with a front wall folded upwardly along a front edge of the rectangular base, a back wall folded upwardly along a back edge of the rectangular base, a outer cover panel extension to the front wall having a pair of widths and having a cover tuck flap, wherein each edge along the pair of widths in the outer cover panel extension has cutouts in a smooth shape, an inner cover panel extension to the back wall having a pair of widths folded along a top edge of the back wall, each edge along the pair of widths of the inner cover panel extension has cutouts in a smooth shape and a pair of end walls extending upwardly along a side edge of the rectangular base with a pair of grab areas allowing fingers extending towards outer cover panel passing over cutouts having the smooth shape.

12 Claims, 16 Drawing Sheets

STORAGE CONTAINER

BACKGROUND

Storage containers are of growing importance in commerce as more products are being shipped to individual customers. Depending on the product being shipped, the storage container may need to be specially designed to both fit and protect the product. To ship fruits and other perishables, the containers need to protect the fruits from being damaged during shipping and handling. Also, the box needs to have sufficient strength to hold the heavier weight of the fruit and withstand stacking several containers upon each other without crushing from the overall weight.

Conventional boxes tend to be designed for shipping fruit and other product for retail stores and other outlets. These conventional boxes assume that the person receiving the boxes and the product are employees of the retail store or people responsible for receiving large pallets of products at these stores. Accordingly, the boxes may be design to fit on these pallets and moved around using forklifts, hand trucks and other heavy equipment. Once the pallet is received, the boxes are lifted off the pallet and the contents, such as fruit, quickly removed and placed on displays. Often, the individual boxes are not moved far from the pallet hence their design does not have to be appealing to the individual user. Even if the boxes are moved any distance, the grocers and other individuals are generally expected to lift and move heavy boxes as part of their job duties as well as wear protective gloves and other equipment to protect themselves. Very little thought is placed into designing boxes and packaging for fruit and other food stuffs that considers protecting the goods inside but the usability of the container to the end user.

Consequently, it is difficult to ship fruit as gifts in conventional boxes as they may be hard to handle, look cheaply made or generally not be aesthetically appealing. This is often not the impression desired when sending fruit or other perishables as a gift to be placed in a home kitchen or office environment. Unfortunately, the conventional storage containers that are capable of shipping fruit and perishables do not address these and other related issues.

SUMMARY

Aspects of the present invention feature a storage container formed from cardboard material. The storage contain includes a rectangular base unit having a front wall folded upwardly along a folded front edge of the rectangular base, a back wall folded upwardly along a folded back edge of the rectangular base with at least one cover slot and integral cover secure flap, a outer cover panel extension to the front wall having a pair of widths folded in a parallel relationship to the rectangular base along a folded top edge of the front wall and having at least one cover tuck flap, wherein each edge along the pair of widths has a pair of cutouts in a smooth shape, an inner cover panel extension to the back wall having a pair of widths folded along a folded top edge of the back wall in a spaced and parallel relationship to the rectangular base, wherein each edge along the pair of widths has a pair of cutouts in a smooth shape, a pair of front side panels along a scored side edge of the front wall, a pair of back side panels each extending laterally and inwardly along a scored side edge of the back wall and a pair of end walls each extending upwardly along a scored side edge of the rectangular base, each end wall having at least one slotted tab at the lower end of each end wall and an inner end wall extending along a double-scored top edge of each end wall folded inwardly and downwardly around the top end of each end wall and wrapping around a front side panel and a back side panel while having a slotted tuck flap extension designed with at least one slot to cooperate and lock into the at least one slotted tab at the lower end of each end wall, wherein a pair of grab areas in the pair of end walls allow fingers to be placed into grab areas extend upwards towards outer cover panel passing over the pair of cutouts having the smooth shape.

DETAILED DESCRIPTION

Figure 1:
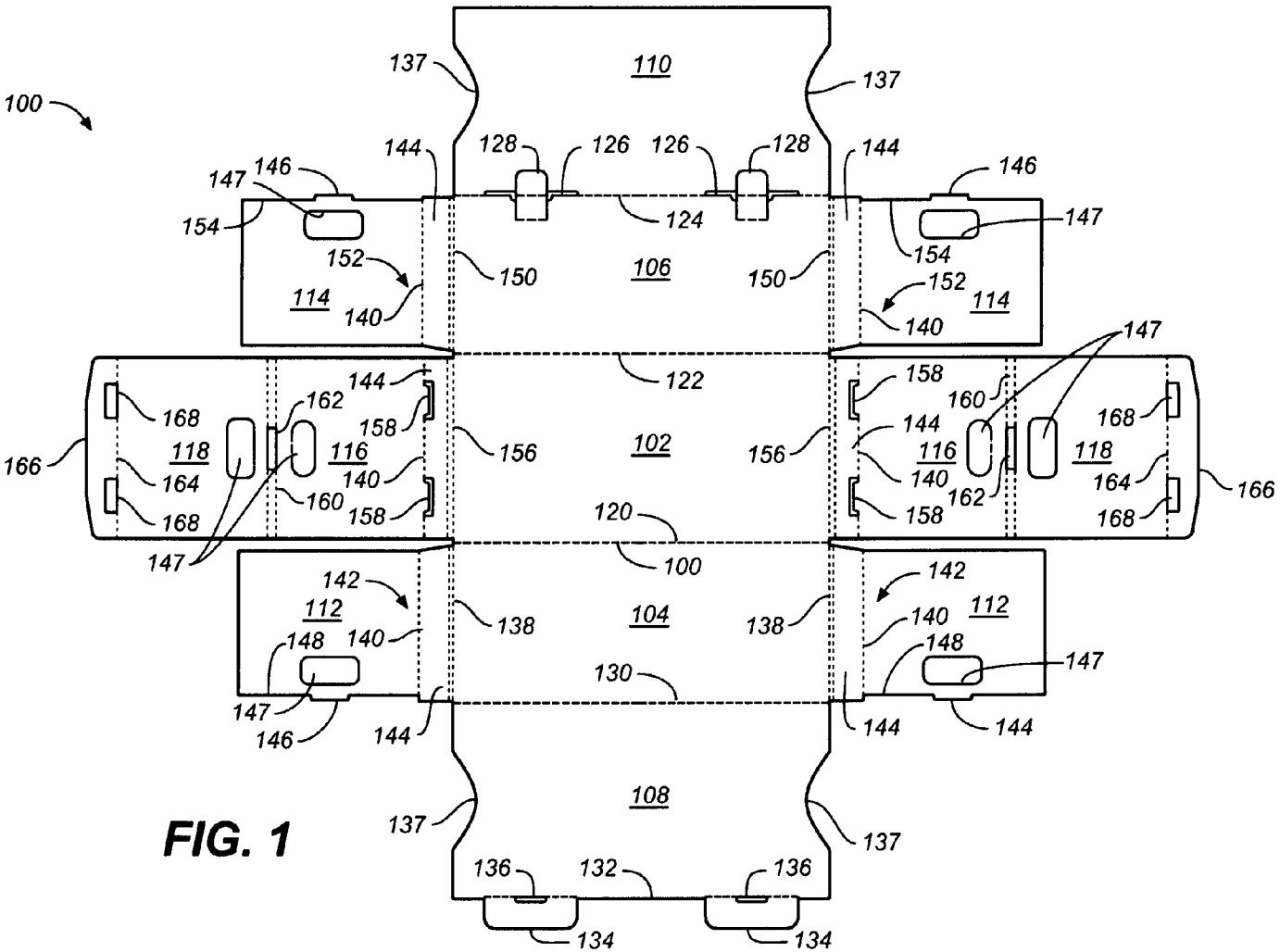
FIG. 1 is a storage container depicted in accordance with implementations of the present invention in an unassembled state.

Referring to FIG. 1, a storage container 100 is depicted in accordance with implementations of the present invention in an unassembled state. While it may be possible to glue one or more portions, storage container 100 has been designed to provide sufficient structural integrity and overall strength for shipping and handling without the need of glues or seals. Alternate implementations described later herein may be assembled and affixed together with glue in addition to folding and tucking of the various panels and flaps. It is contemplated that other types of seals to indicate authenticity or tampering with the contents may be added as seen fit by the shipping or receiving party. With appropriate inserts, storage container 100 may be used for storing and shipping fruits or perishables as well as any other number of items.

Storage container 100 can be implemented using a single cardboard sheet having a rectangular base 102, a front wall 104, a back wall 106, an outer cover panel 108, an inner cover panel 110, a pair of front side panels 112, a pair of back side panels 114, a pair of end walls 116 and a pair of inner wall 118 extensions there from.

Rectangular base 102 is connected to front wall 104 by way of a fold along front edge 120. Similarly, rectangular base 102 is also connected to back wall 106 by way of another fold along back edge 122. At the top edge 124 of back wall 106 is at least one cover slot 126 and integral cover secure flap 128 that extends from within cover slot 126. Inner cover panel 110 extends from back wall 106 along a folded top edge 124. For example, the example implementation depicted in FIG. 1 includes a pair of cover slots 126 and a pair of integral cover secure flaps 128 however greater or fewer slots and flaps can also be used. In one implementation, a pair of cutouts 137 are made into the inner cover panel 110 to increase the ergonomics and usability of the storage container as further described later herein.

Outer cover panel 108 extends from front wall 104 by way of a folded top edge 130. Along the top edge 132 of outer cover panel 108 is at least one cover tuck flap 134 and integral cover secure slot 136 corresponding to the number of cover slots 126 and integral cover secure flaps 128 associated with back wall 106. For example, a pair of cover tuck flaps 134 and integral cover secure slots 136 is matched with the pair of cover slots 126 and integral cover secure flaps 128 in the example implementation in FIG. 1. Like the aforementioned outer cover panel 110, a pair of cutouts 137 of similar dimension and shape are also made into the outer cover panel 108.

Front side panels 112 extend from side edges 138 of front wall 104 along a double-scored perforation to facilitate multiple flat folds of cardboard material. An additional scoring 140 is made between the side portions 142 of each front side panel 112 forming an inset panel 144. In addition, each of front side panels 112 has a side panel tab 146 extending from the top edge 148 of the front side panels 112. Grab areas 147 are cut out of front side panels 112 as indicated in order to insert fingers and better carry storage container 100. For example, the grab areas 147 are elliptical in shape to better form to a hand and fingers placed within and not create sharp edges. However, it is also contemplated that grab areas 147 may be formed using rectangular, trapezoidal or other shapes.

Likewise, back side panels 114 extend from side edges 150 of back wall 106 also along double-scored perforations. To also provide for inset panels 144, additional scoring 140 is made between the side portions 152 of back side panels 114. Once again, each of back side panels 114 has a side panel tab 146 extending from the top edge 154 of back side panels 114. Like the front side panels 112, back side panels 114 also have grab areas 147 cut out in order to accommodate fingers when carrying storage container 100.

Rectangular base 102 also has a pair of end walls 116 extending from side edge 156 along double-scored perforations. Each end wall 116 has at least one slotted tab 158 at the lower end of each end wall. For example, in FIG. 1 each end wall 116 has a pair of slotted tabs 158. End walls 116 also have grab areas 147 formed in similar shape and dimension to those found in front side panels 112 and back side panels 114.

Beyond end walls 116 are inner end walls 118 extended along a double-scored perforation 160 having a side tab slot 162 positioned there between the pair of perforations. At the top edge 164 of each of inner end walls 118 along a perforation is a slotted tuck flap extension 166 having at least one slot 168 and corresponding to the number of slotted tabs 158. For example, FIG. 1 depicts a pair of slots 168 along top edge 164 of inner end walls 118 to match the pair of slotted tabs 158 along additional scoring 140. Inner end walls 118 also have grab areas 147 corresponding to those grab areas 147 found in the other aforementioned portions of storage container 100 as illustrated.

Cutouts 137 of approximately the same geometry made into both inner cover panel 110 and outer cover panel 108 as illustrated in FIG. 1 work in conjunction with grab areas 147. In one implementation, these cutouts 137 are in the shape of a sickle or crescent as illustrated however many other shapes for the cutouts are possible. For example, it is also contemplated that cutouts 137 may be based upon rectangular, trapezoidal, circular, elliptical and other geometries as best suited for the particular application and aesthetic appeal.

Generally, these cutouts 137 are included in accordance with aspects of the present invention so as to not hinder a person's hands or arms as they are carrying storage container 100. For example, fingers may be placed into grab areas 147 extending upwards towards outer cover panel 108 and passing across cutouts 137. Palms of the hands and/or thumbs may rest on top of outer cover panel 108 in an ergonomic manner thus making carrying storage container 100 easier.

Alternatively, fingers may be placed on underside of rectangular base 102 along side edges 156 with extended forearms or other portion of the arms also passing across cutouts 137. The placement of cutouts 137 in this instance allows the arms to comfortably extend downward while carrying storage container 100. By opening up the area of cutouts 137, the arms are not chafed by the edges of the cardboard or other material used to construct storage container 100.

Figure 2A:
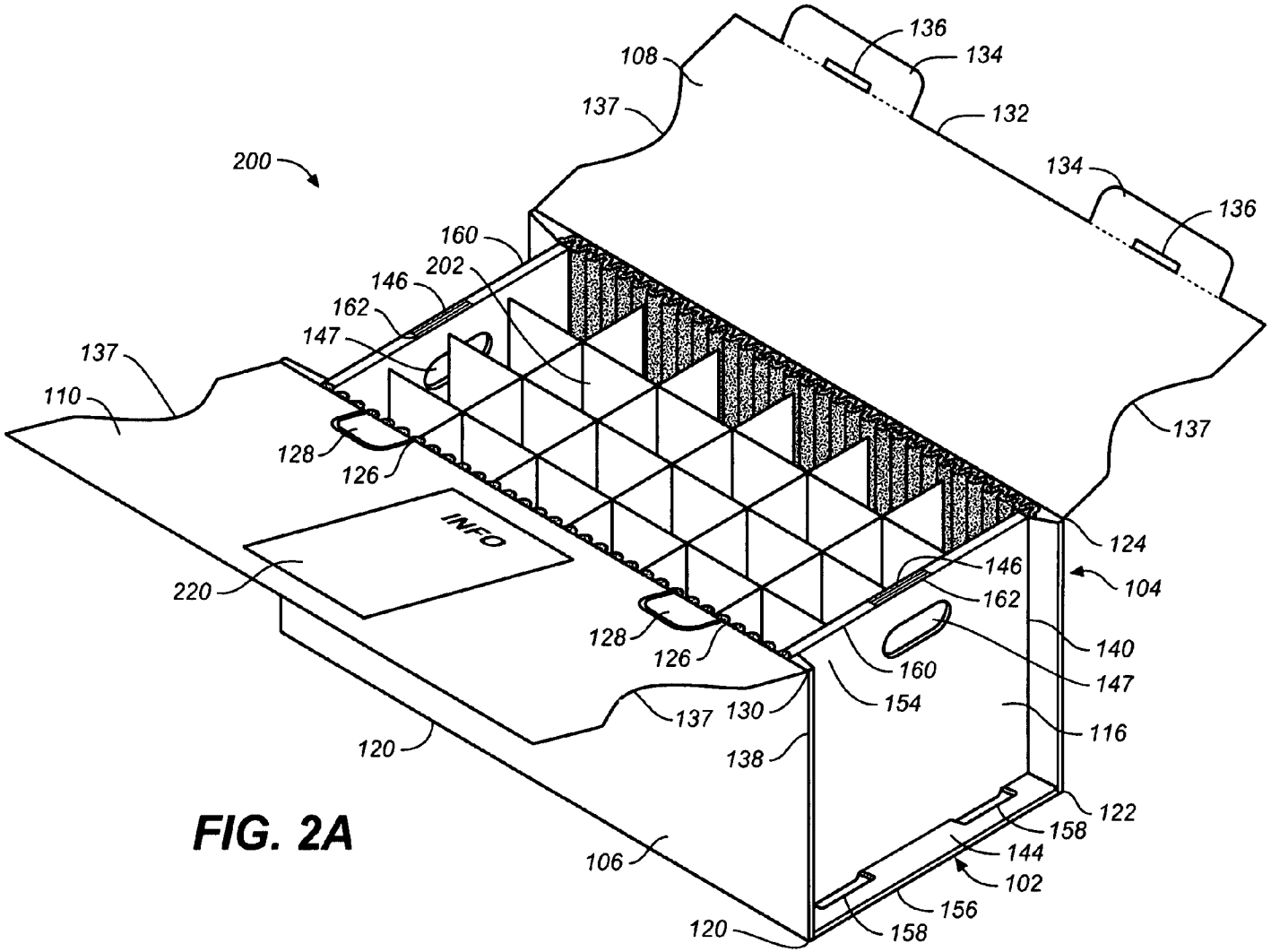
FIG. 2A is diagram of an assembled storage container having a criss-cross insert suitable for receiving fruit, perishables or other objects.

FIG. 2A is diagram of an assembled storage container 200 having a criss-cross insert 202 suitable for receiving fruit, perishables or other objects. As illustrated, assembled storage container 200 has rectangular base 102 having front wall 104 folded upwardly along a folded front edge 122 of the rectangular base 102. A back wall 106 is folded upwardly along a folded back edge 120 of the rectangular base 102. At the top edge 124 of back wall 106 is a pair of cover slots 126 and integral cover secure flaps 128 extended from within cover slot 126.

Also illustrated is outer cover panel 108 to be folded in a spaced and parallel relationship to rectangular base 102 along a folded top edge 124 as an extension to front wall 104. At the top edge 132 of outer cover panel 108 illustrated in FIG. 2A is an example implementation having a pair of tuck flaps 134 with an integral cover secure slots 136 both cooperating with the cover slots 126 and integral cover secure flaps 128 respectively along the top edge 130 of back wall 106.

To strengthen assembled storage container 200 and the cover area, inner cover panel extension 110 is folded along the top edge 130 of back wall 106 forming another layer of material and adding rigidity to the over assembled storage container 200. On the interior facing side of inner cover panel extension 110 can be placed information 220 or advertising as depicted by the printed or mounted information 220 titled "INFO". Both outer cover panel 108 and inner cover panel extension 110 are positioned in a spaced and parallel relationship to rectangular base 102 when assembled storage container 200 is closed.

Ends of assembled storage container 200 are reinforced by a pair of front side panels 112 (not visible in FIG. 2) each extending laterally and inwardly along a doubly scored side edge 138 of front wall 104 and having side panel tab 146 on top edge 148 of each front side panel 112. Further reinforcement to the ends of assembled storage container 200 is provided in a similar manner by a pair of back side panels 114 (not visible in FIG. 2) each extending laterally and inwardly along a doubly scored side edge 150 of back wall 106. Each of back side panels 114 also has a side panel tab 146 on the top edge 154 of each back side panel 114. Both of the side panel tabs 146 of front side panel 112 and back side panel 114 fit cooperatively into side tab slot 162 positioned between double-scored perforation 160.

A pair of end walls 116 each extends upwardly along a doubly scored side edge 156 of the rectangular base 102. An inset panel 144 having a uniform depth is formed according to a width defined according to an additional scoring 140. The width of inset panel 144 corresponds to a distance between a lower portion of each end wall 116 and just above the side edge 156 of the rectangular base 102 indicated by the additional scoring 140. Likewise, a matching width on the inset panel 144 is defined according to an additional scoring 140 adjacent to a side edge 138 on front side panels 112 and the additional scoring 140 adjacent to a side edge 150 on back side panels 114. By folding double-scored top edge 160 of each end wall 116 inwardly and downwardly around the top end of each end wall 116 and wrapping around front side panels 112 and back side panels 114 greatly increases the overall strength of assembled container 200. For added security, slotted tuck flap 166 (not visible in FIG. 2) is an extension designed with at least one slot 168 to cooperate and lock into the at least one slotted tabs 158 at the lower end of each end wall 116.

Figure 2B:
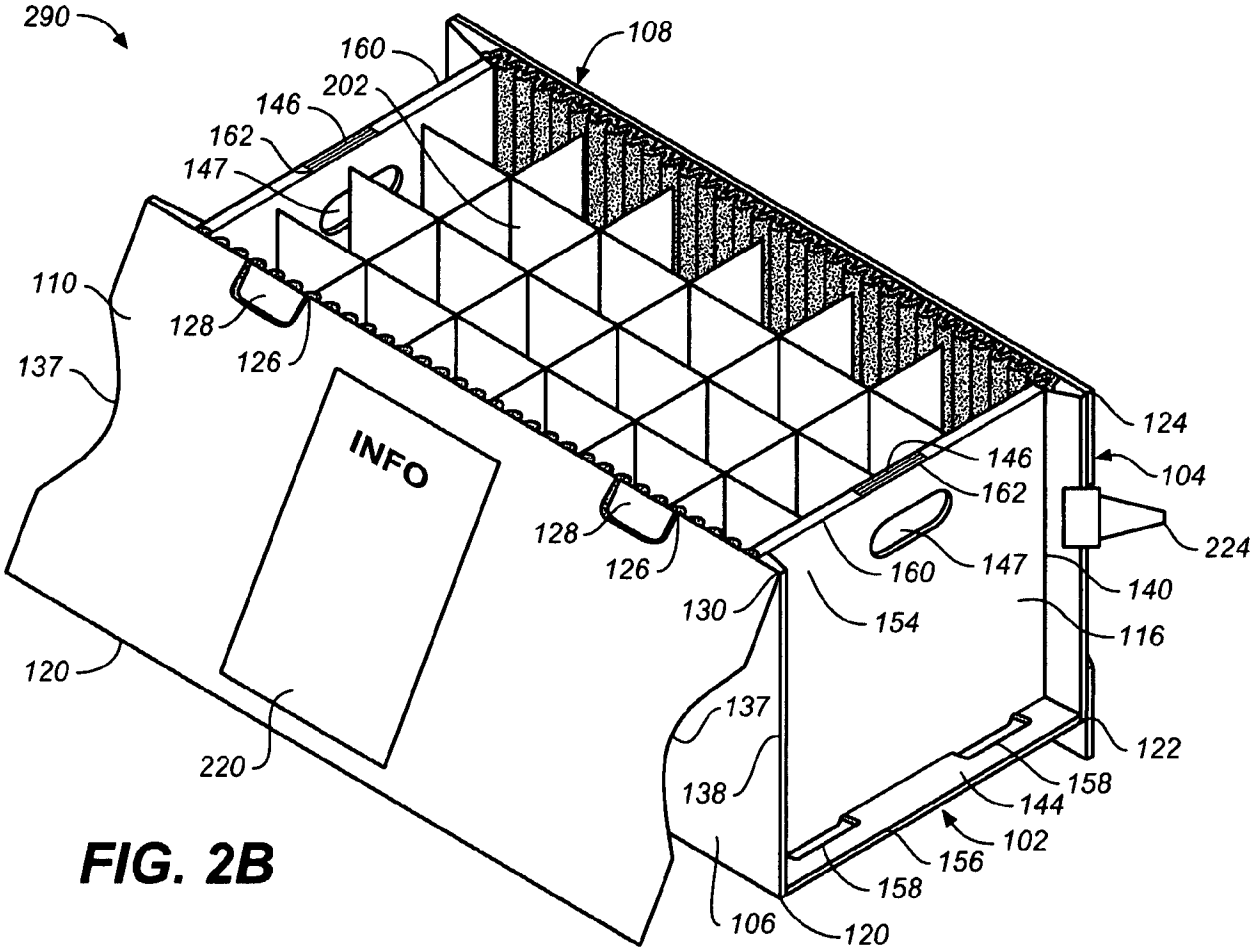
FIG. 2B is diagram of an assembled storage container configured as a display center for fruit, perishables or other objects.

FIG. 2B is diagram of an assembled storage container 290 configured as a display center for fruit, perishables or other objects. Compared with FIG. 2A, assembled storage container 290 has outer cover panel 108 folded in a substantially orthogonal relationship to rectangular base 102. Notably, outer cover panel 108 extends further in distance than front wall 104 and when fixed in place causes assembled storage container 290 to lift at an angle along rectangular base 102. Fasteners 224 keep outer cover panel 108 in position and at a slight to moderate angle. For example, one type of fastener 224 can be implemented using one or more conventional binder clips attached onto the cardboard front wall 104 and outer cover panel 108. This makes it easier to view and select items from assembled storage container 290. For example, a person can more readily view and select fruit from assembled storage container 290 when it is configured as a display center for the fruit. In addition, information 220 is also displayed making it useful to provide information about the items in assembled storage container 290 or provide certain advertising related to the items or of particular interest to the recipient of assembled storage container 290.

Figure 3:
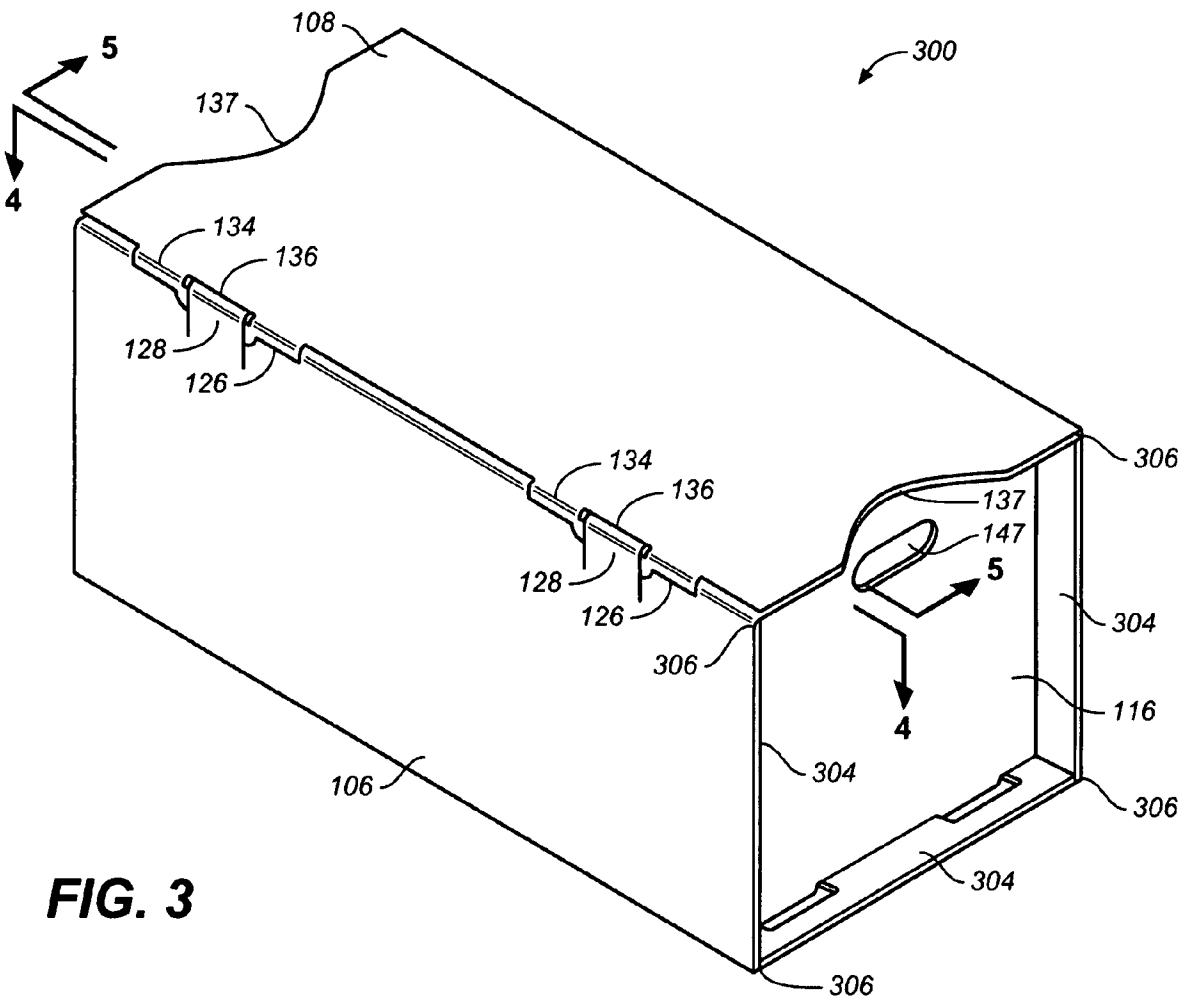
FIG. 3 depicts a fully assembled and closed storage container designed in accordance with one implementation of the present invention.

FIG. 3 depicts a fully assembled and closed storage container 300 designed in accordance with one implementation of the present invention. Closed storage container 300 depicted in FIG. 3 illustrates outer cover panel 108 secured in place by a pair of cover tuck flaps 134 inserted into pair of cover slots 126 and integral cover secure flaps 128 inserted into integral cover secure slots 136. This arrangement facilitates keeping closed storage container 300 in a secure arrangement for shipping and handling.

Top portion of end walls 116 wrapping around front side panels 112 (not visible in FIG. 3) and back side panels 114 (not visible in FIG. 3) combined with outer cover panel 108 and inner cover panel 110 increase the overall strength of closed storage container 300 especially in the vicinity of the inset panels 144. Grab areas 147 make a convenient and strong handle for lifting closed storage container 300 provided added clearance provided by cutouts 137 to accommodate hands and/or arms while carrying. In addition, this arrangement also provides for crush corners 306 that protect contents from various forces that may occur during shipping of handling of closed storage container 300. As a purely aesthetic feature, edging 304 on the sides and bottom portions creates a recognizable overall appearance in both the closed storage container 300 as well as in the assembled yet opened storage container 200 depicted in FIG. 2 and elsewhere.

Figure 4:
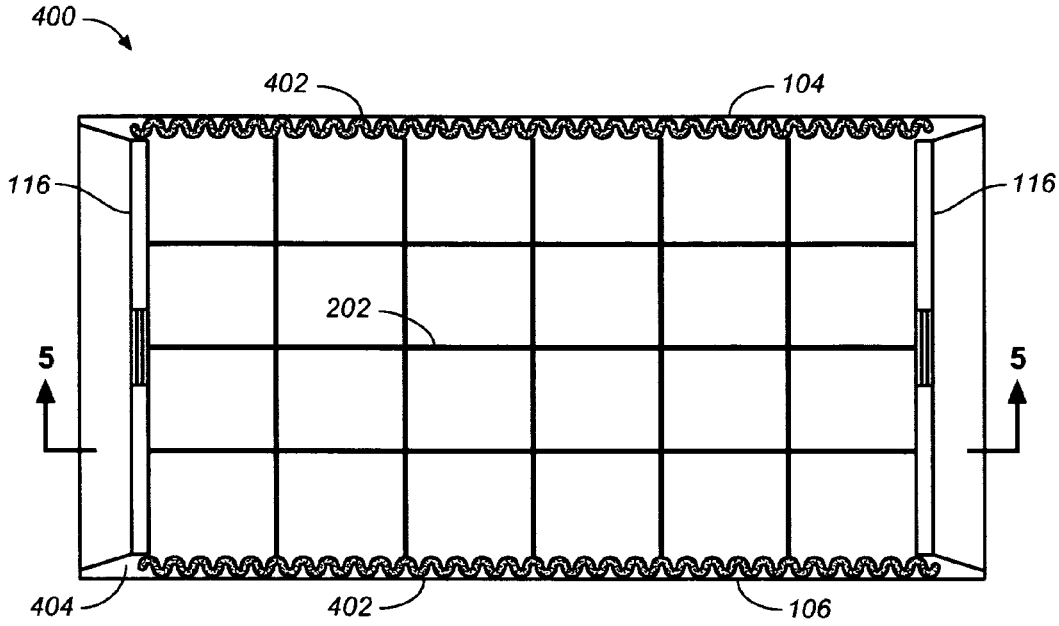
FIG. 4 depicts a storage container from a top-view having crisscross inserts and packing material.

FIG. 4 depicts a storage container 400 from a top-view (see lines 4-4 in FIG. 2) having criss-cross inserts 202 and packing material 402. As previously described, criss-cross inserts 202 can be used to pack fruits and other perishables that may fit in the spaces formed by the intersection of the slats of cardboard or other materials. These criss-cross inserts 202 serve to keep the items being shipped in place and from hitting each other as well as provide some protection from mechanical shock to the overall storage container 400. Similarly, packing material 402 is placed on sides to increase resistance to mechanical shock applied to outside faces of the box. For example, packing material 402 can be a biodegradable cushioning material derived from corn starch or other similar materials. Alternatively, it can be constructed from paper or, if necessary, lesser biodegradable petrochemical derived materials.

Gap 404 is formed from an angular recess of end walls 116 along with front wall 104 and back wall 106 that receives packing material 402. Together, the placement of packing material 402 into gap 404 causes a firm packing of items in storage container 400 when it is closed as the packing material 402 is compressed against back wall 104 and front wall 106. While packing material 402 can also be placed flatly across criss-cross inserts 202, it has been omitted to allow viewing the interior of storage container 400.

Figure 5:
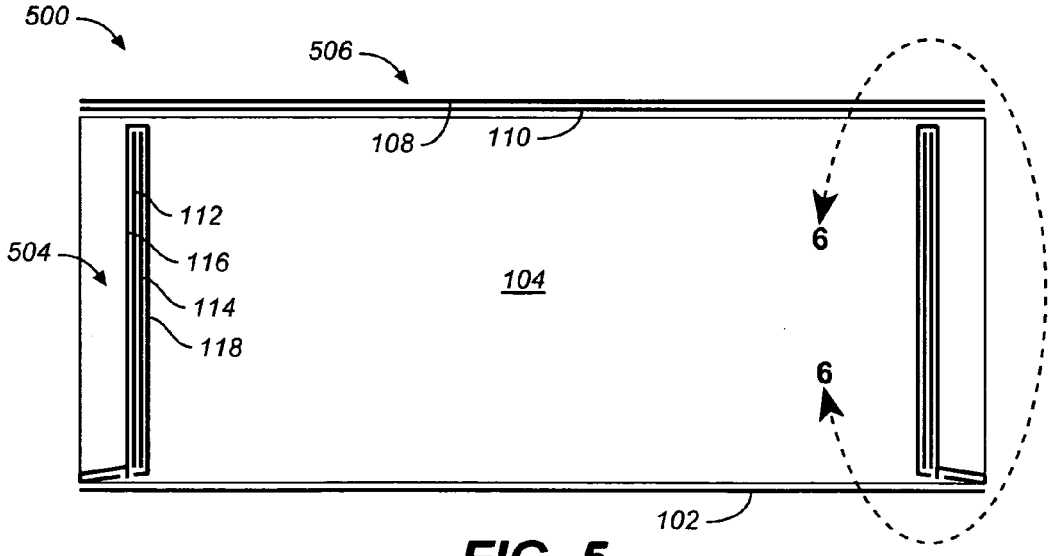
FIG. 5 is a storage container from a side view depicting the folding of multiple cardboard sheets and increased strength in the storage container.
Figure 6:
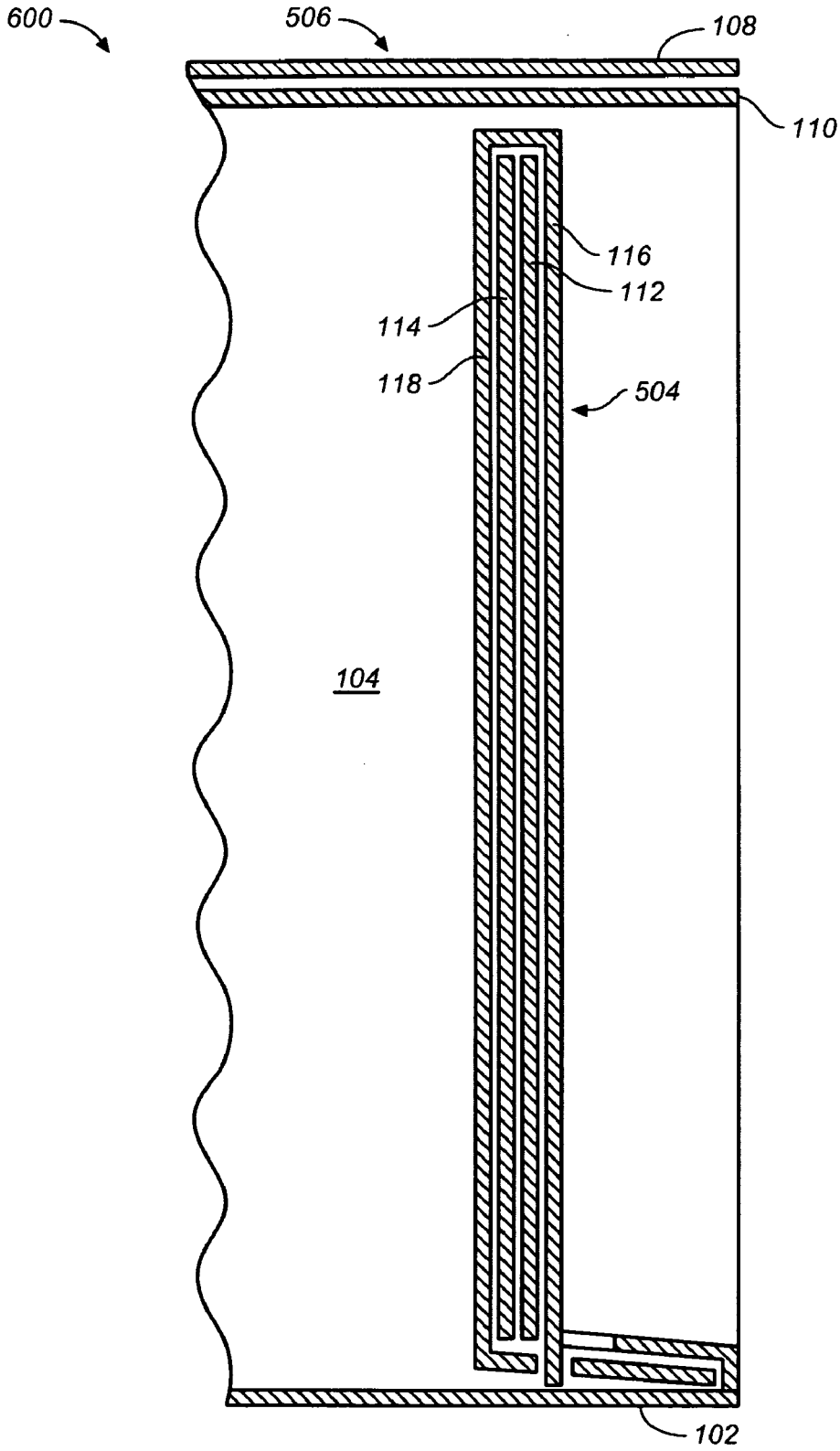
FIG. 6 is a detail of storage container from a side view demonstrating the composite ends and a composite cover.

FIG. 5 is a storage container 500 side view (see line 5-5 in FIG. 2) depicting the folding of multiple cardboard sheets and increased strength in the storage container 500. In the example illustration, composite ends 504 of storage container are formed from end wall 116 and inner end walls 118 both folded inwardly and downwardly around the top end of each end wall 116 and wrapping around back side panels 112 and front side panels 114. Composite cover 506 includes a layering of both outer cover panel 108 and inner cover panel extension 110 in a spaced and parallel relationship to rectangular base 102 when storage container 500 is closed FIG. 6 is a detail of storage container 600 side view (see line 6-6 in FIG. 5) demonstrating the composite ends 504 and composite cover 506. From the detail side view, composite ends 504 of storage container are formed from end wall 116 and inner end walls 118 both folded inwardly and downwardly around the top end of each end wall 116 and wrapping around back side panels 112 and front side panels 114. Composite cover 506 includes a layering of both outer cover panel 108 and inner cover panel 110 in a spaced and parallel relationship to rectangular base 102 when storage container 600 is closed.

Figure 7:
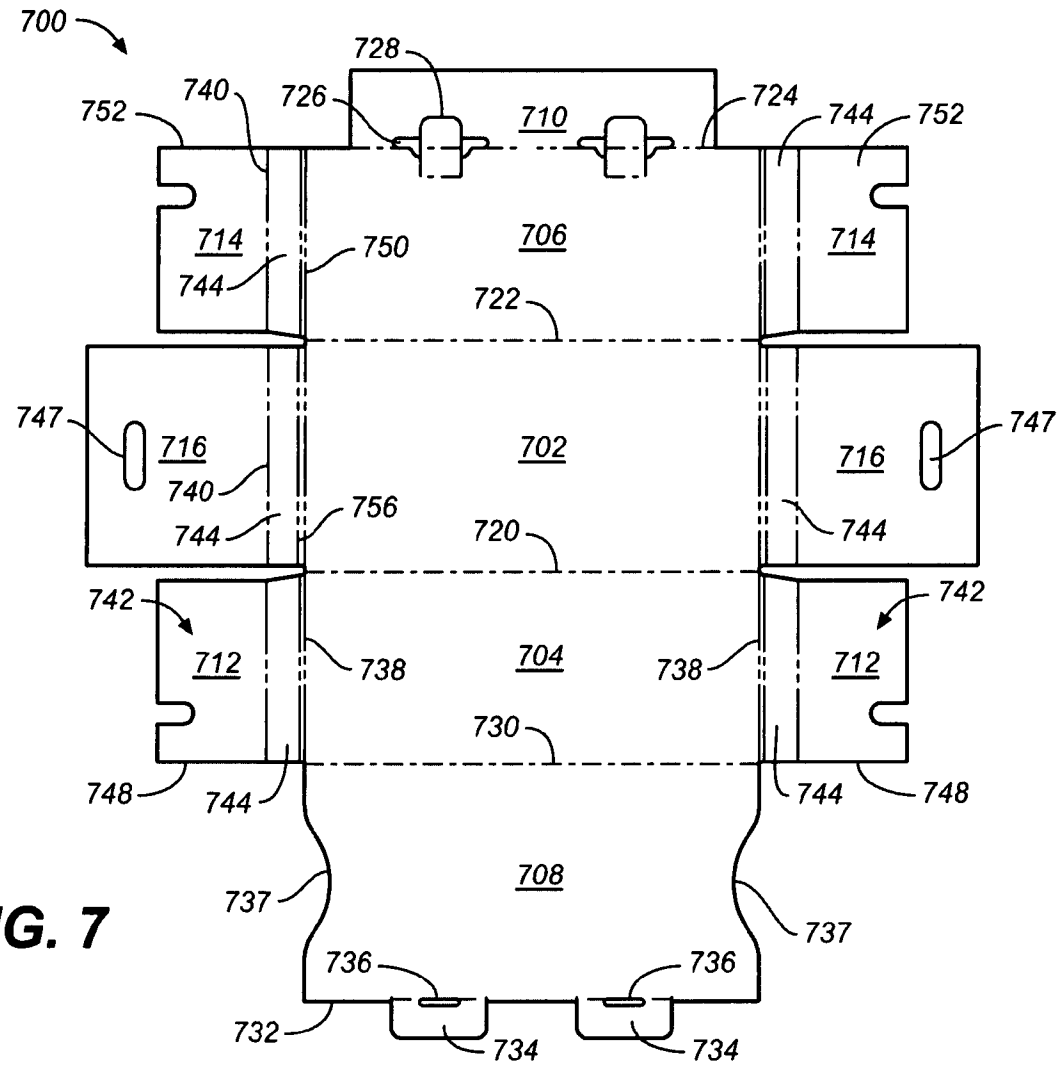
FIG. 7 is one alternative implementation of the present invention depicting a glued storage container assembled using adhesive materials in addition to folds.

FIG. 7 is an alternative implementation of a glued storage container 700 assembled using adhesive materials in addition to folds. Glued storage container 700 also can be implemented using a single cardboard sheet having a rectangular base 702, a front wall 704, a back wall 706, an outer cover panel 708, an inner cover panel 710, a pair of front side panels 712, a pair of back side panels 714 and a pair of end walls 716.

Rectangular base 702 is connected to front wall 704 by way of a fold along front edge 720. Similarly, rectangular base 702 is also connected to back wall 706 by way of another fold along back edge 722. At the top edge 724 of back wall 706 is at least one cover slot 726 and integral cover secure flap 728 that extends from within cover slot 726. Inner cover panel 710 extends from back wall 706 along the folded top edge 724. For example, the example implementation depicted in FIG. 7 includes a pair of cover slots 726 and a pair of integral cover secure flaps 728 however greater or fewer slots and flaps can also be used.

Outer cover panel 708 extends from front wall 704 by way of a folded top edge 730. Along the top edge 732 of outer cover panel 708 is at least one cover tuck flap 734 and integral cover secure slot 736 corresponding to the number of cover slots 726 and integral cover secure flaps 728 associated with back wall 706. For example, a pair of cover tuck flaps 734 and integral cover secure slots 736 is matched with the pair of cover slots 726 and integral cover secure flaps 728 in the example implementation in FIG. 7. In one implementation, a pair of cutouts 737 are made into the inner cover panel 708 to increase the ergonomics and usability of the storage container as further described later herein.

Front side panels 712 extend from side edges 738 of front wall 704 along a double-scored perforation to facilitate multiple flat folds of cardboard material. An additional scoring 740 is made between the side portions 742 of each front side panel 712 forming an inset panel 744. A "U' shaped notch at the top edge of front side panels 712 corresponds to a grab area 747 when folded.

Likewise, back side panels 714 extend from side edges 750 of back wall 706 also along double-scored perforations. To also provide for inset panels 744, additional scoring 740 is made between the side portions 752 of back side panels 114. Likewise, a "U' shaped notch at the top edge of back side panels 714 corresponds to the grab area 747 when folded.

Rectangular base 702 also has a pair of end walls 716 extending from side edge 756 along double-scored perforations. Both end walls 716 also have grab areas 747 formed in similar shape and dimension. Grab areas 747 are cut out of front side panels 112 as indicated in order to insert fingers and better carry glued storage container 700. For example, the grab areas 147 are elliptical in shape to better form to a hand and fingers placed within and not create sharp edges. However, it is also contemplated that grab areas 747 may also be formed using rectangular, trapezoidal or other shapes.

Cutouts 737 of approximately the same geometry are made into outer cover panel 708 as illustrated in FIG. 7 work in conjunction with grab areas 747. In one implementation, these cutouts 737 are in the shape of a sickle or crescent as illustrated however many other shapes for the cutouts are possible. For example, it is also contemplated that cutouts 737 may be based upon rectangular, trapezoidal, circular, elliptical and other geometries as best suited for the particular application and aesthetic appeal.

Generally, these cutouts 737 are included in accordance with aspects of the present invention so as to not hinder a person's hands or arms as they are carrying glued storage container 700. For example, fingers may be placed into grab areas 747 extending upwards towards outer cover panel 708 and passing across cutouts 737. Palms of the hands and/or thumbs may rest on top of outer cover panel 108 in an ergonomic manner thus making carrying glued storage container 700 easier.

Alternatively, fingers may be placed on underside of rectangular base 702 along side edges 756 with extended forearms or other portion of the arms also passing across cutouts 737. The placement of cutouts 737 in this instance allows the arms to comfortably extend downward while carrying storage container 700. By opening up the area of cutouts 737, the arms are not chafed by the edges of the cardboard or other material used to construct glued storage container 700. It is contemplated that one skilled in the art provided at least FIG. 7 and other descriptions herein would be able to identify one or more locations for glue to assemble the glued storage container 700 into a finished product that appears similar to storage container 200 in FIG. 2A. Some of the many benefit of the glued storage container 700 compared with storage container 200 is less required material and simpler assembly.

Figure 8:
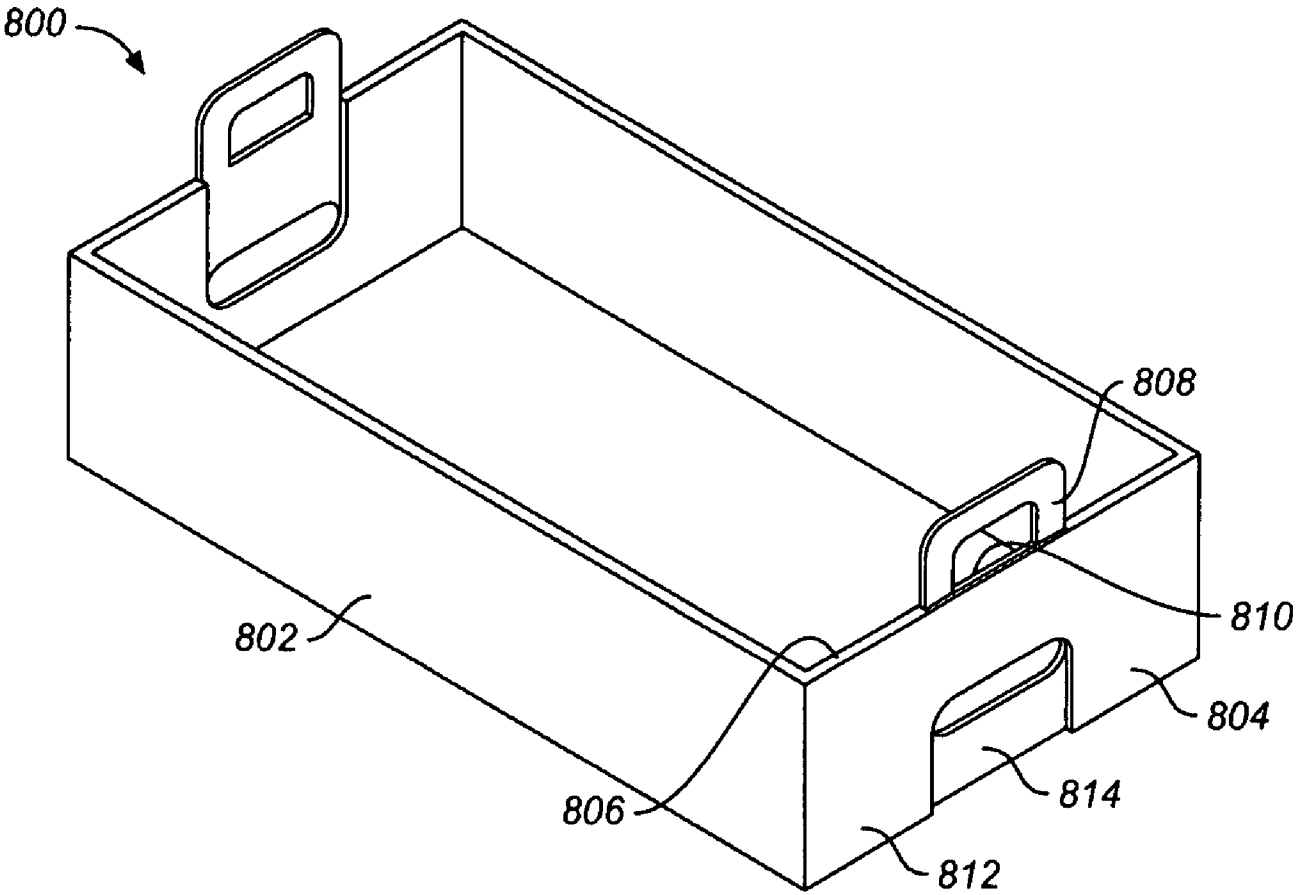
FIG. 8 depicts a tray storage container in accordance with further aspects of the present invention.

FIG. 8 depicts a tray storage container 800 in accordance with further aspects of the present invention. Tray storage container 800 may function as an insert to other storage containers such as storage container 100, glued storage container 700 as well as other storage containers described in further detail later herein or as an independent storage container not to be inserted into other containers. In either usage, tray storage container 800 can be used to hold fruits, vegetables, nuts and other food stuffs.

In one implementation, tray storage container 800 includes a tray length 802, a tray width 804, a tray handle 808 and a handle interlock 814. Tray handle 810 fits through a handle slot 810 cut into a center portion of a tray width top 806. Likewise, the handle interlock 814 is cut into corresponding center portion of a tray width bottom 812. As described later herein, the dimensions of tray handle 810 fits snuggly into handle interlock 814 thereby facilitating a stacking of two or more of tray storage container 800.

Figure 9:
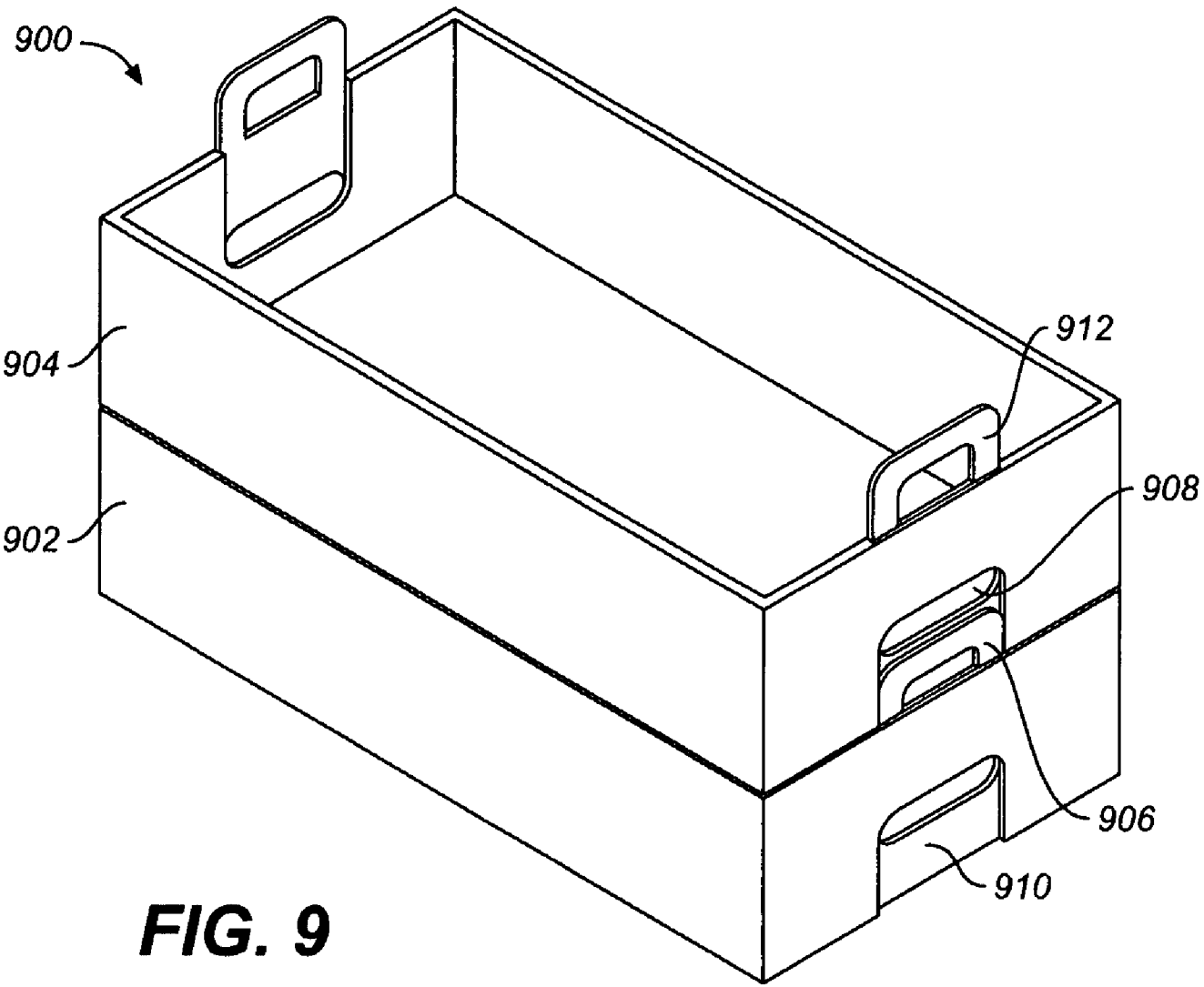
FIG. 9 illustrates a stacked tray storage containers connected using a handle interlock design in accordance with aspects of the present invention.

Stacked tray storage containers 900 illustrated in FIG. 9 are connected using a handle interlock design in accordance with aspects of the present invention. Specifically, a pair of tray storage containers includes a bottom tray storage container 902 (hereinafter "bottom tray") and a top tray storage container 904 (hereinafter "top tray"). A bottom tray handle 906 fits snugly into a top tray handle interlock 908 as illustrated. This arrangement provides additional stability while the trays are stacked and standing alone or when they are inserted within another larger storage container as shown later herein. Yet top tray handle 912 remains sufficiently flexible allowing it to be folded down across the top edge of the top tray 904 such that it does not stand up and hinder placement of a flat surface across the top edges of top tray 904. For example, the top of a box can be placed down over top tray handle 912 pushing the top tray handle 912 into a flattened position. Of course, it is also contemplated that additional storage trays (not shown) can be stacked on top of top tray 904 interlocking with top tray handle 912. Either bottom tray 902 or top tray 904 contain fruit, vegetables or other food stuffs and can be readily carried either together or separately to different locations. Handles like top tray handle 912 allows one to quickly move a portion of the food stuffs to another location to allow easier display of the fruit or vegetables.

Figure 10:
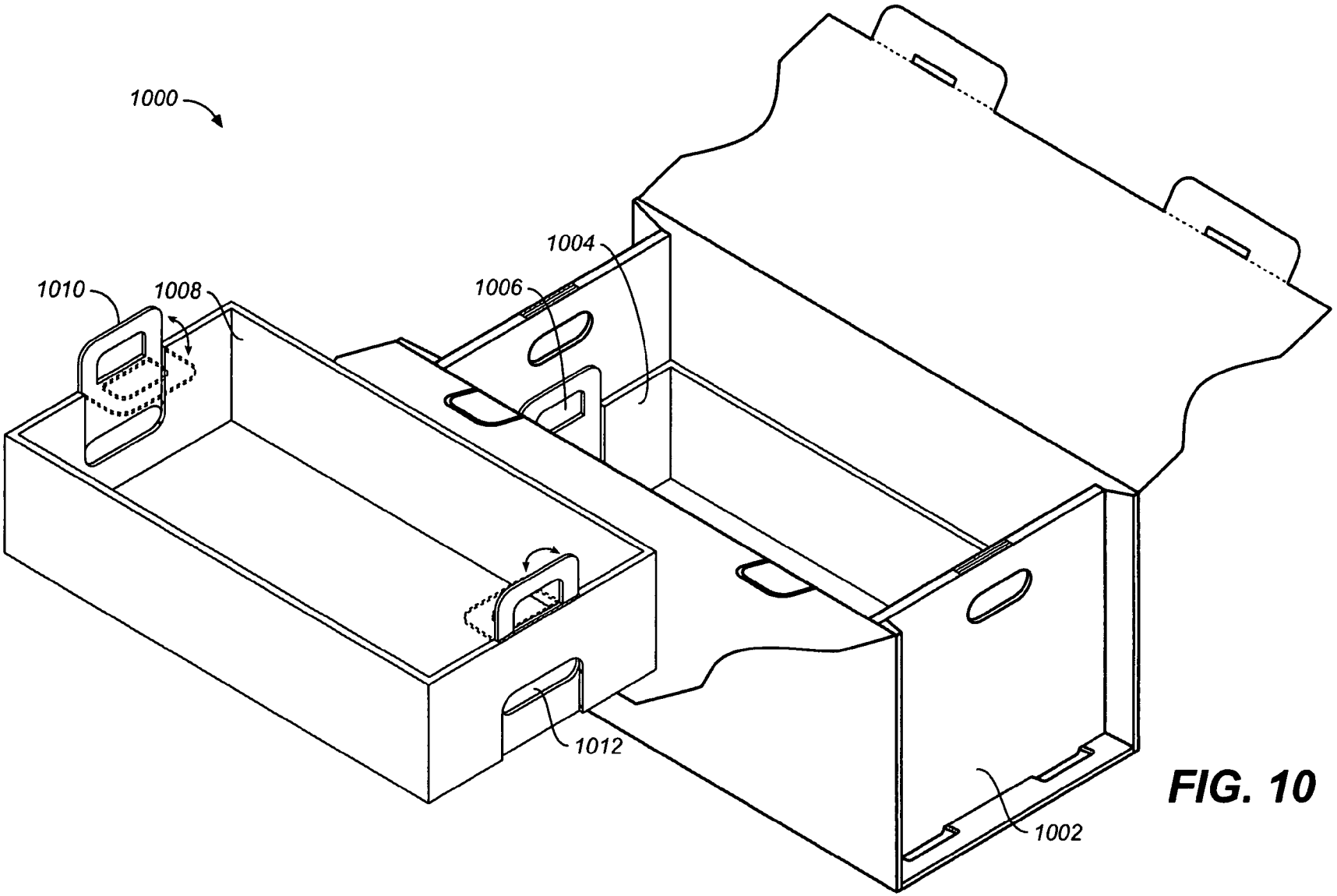
FIG. 10 illustrates a composite storage container having a tray storage containers within a larger storage container in accordance with aspects of the present invention.

FIG. 10 illustrates a composite storage container 1000 having tray storage containers within a larger storage container. In this example, a bottom tray 1004 is first placed in the bottom of a storage container 1002 with a bottom tray handle 1006 extended upwards. In practice, fruits, vegetables, nuts and other food stuffs are placed into bottom tray 1004 in preparation for carrying or shipping. Next, a top tray 1008 is placed down into storage container 1002 setting on top of bottom tray 1004 causing top tray handle interlock 1012 to fit snugly around bottom tray handle 1006. Top tray 1008 is also filled with fruits, nuts, vegetables and other food stuffs as the bottom tray 1004. Upon closing storage container 1002, flexible top tray handle 1010 flexes downward allowing the top of storage container 1002 to close without hindrance from top tray handle 1010.

Placement of tray storage containers, like bottom tray 1004 and top tray 1008, within a larger storage container has many benefits for the packaging of fruit and other food stuffs. For example, a person can receive a large amount of fruits or vegetables in larger storage container 1002 and then quickly separate the amounts into two approximately equal amounts as they are contained in bottom tray 1004 and top tray 1008. The two amounts of food stuffs contained in these two different trays can be carried to two different locations relatively easily. Later, the bottom tray 1004 and top tray 1008 can be returned to the storage container 1002 and then moved in the entirety to another location as required. Unlike conventional storage containers, a person has the option of selecting to carry either a larger amount of food stuffs found in the larger storage container 1002 or a smaller amount of food stuffs contained within each of bottom tray 1004 or top tray 1008. This arrangement is particular useful when shipping fruits and other food stuffs into an office environment where the items are to be shared and multiple containers would allow sharing in different areas or departments within the office.

Figure 11:
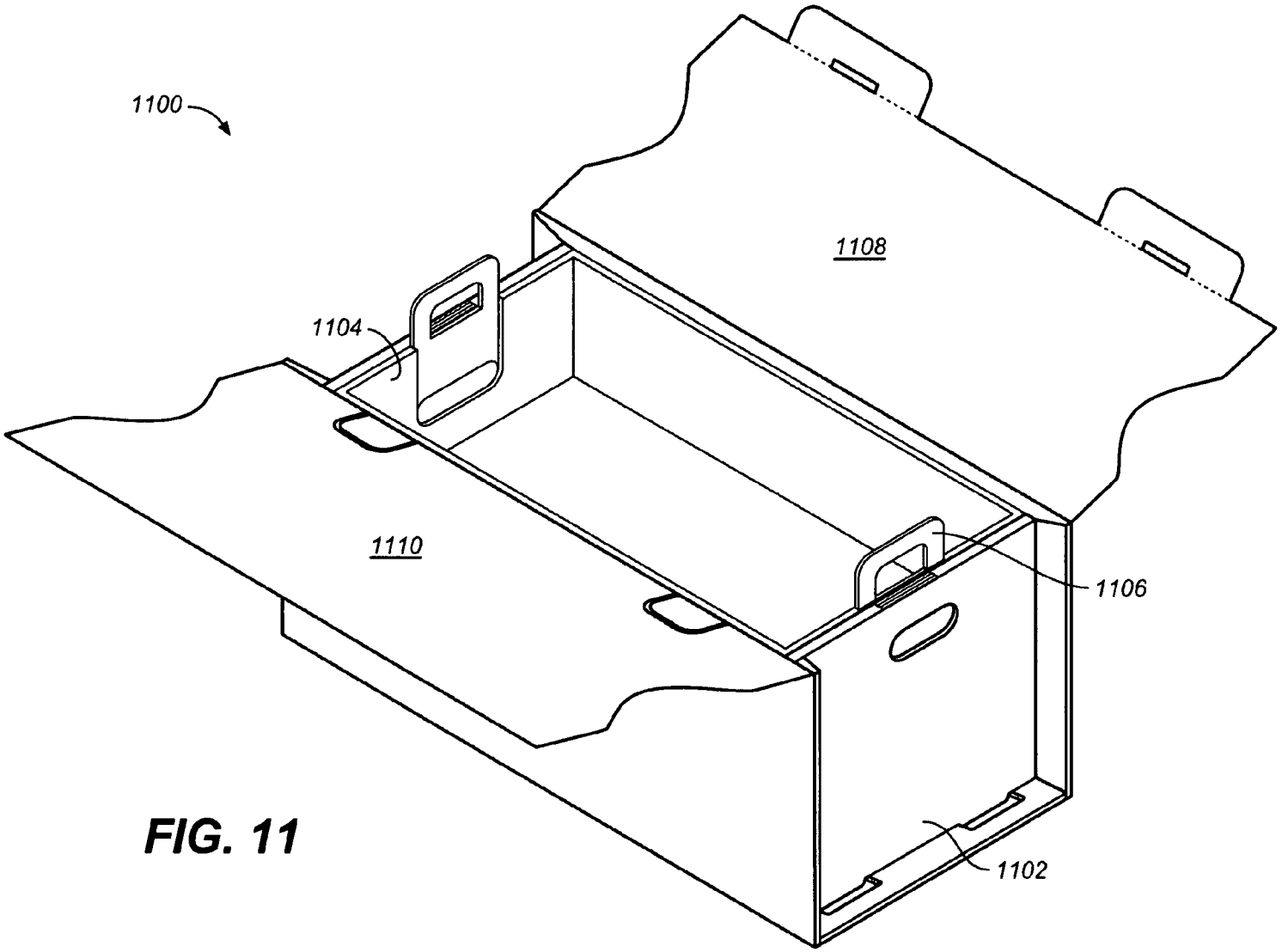
FIG. 11 is a further illustration of a pair of storage trays designed in accordance with aspects of the present invention and placed within a larger storage container.

FIG. 11 is a further illustration of a pair of storage trays designed in accordance with aspects of the present invention and placed within a larger storage container 1102. In this example, a top tray 1104 is placed over a lower tray (not visible) with a lower tray handle connected to the top tray through a top tray handle interlock (not visible). It should be appreciated that that top tray handles 1106 will readily fold down thus allowing both the inner cover 1108 and outer cover 1110 of storage container 1102 to lay flat over the top tray 1104.

Figure 12:
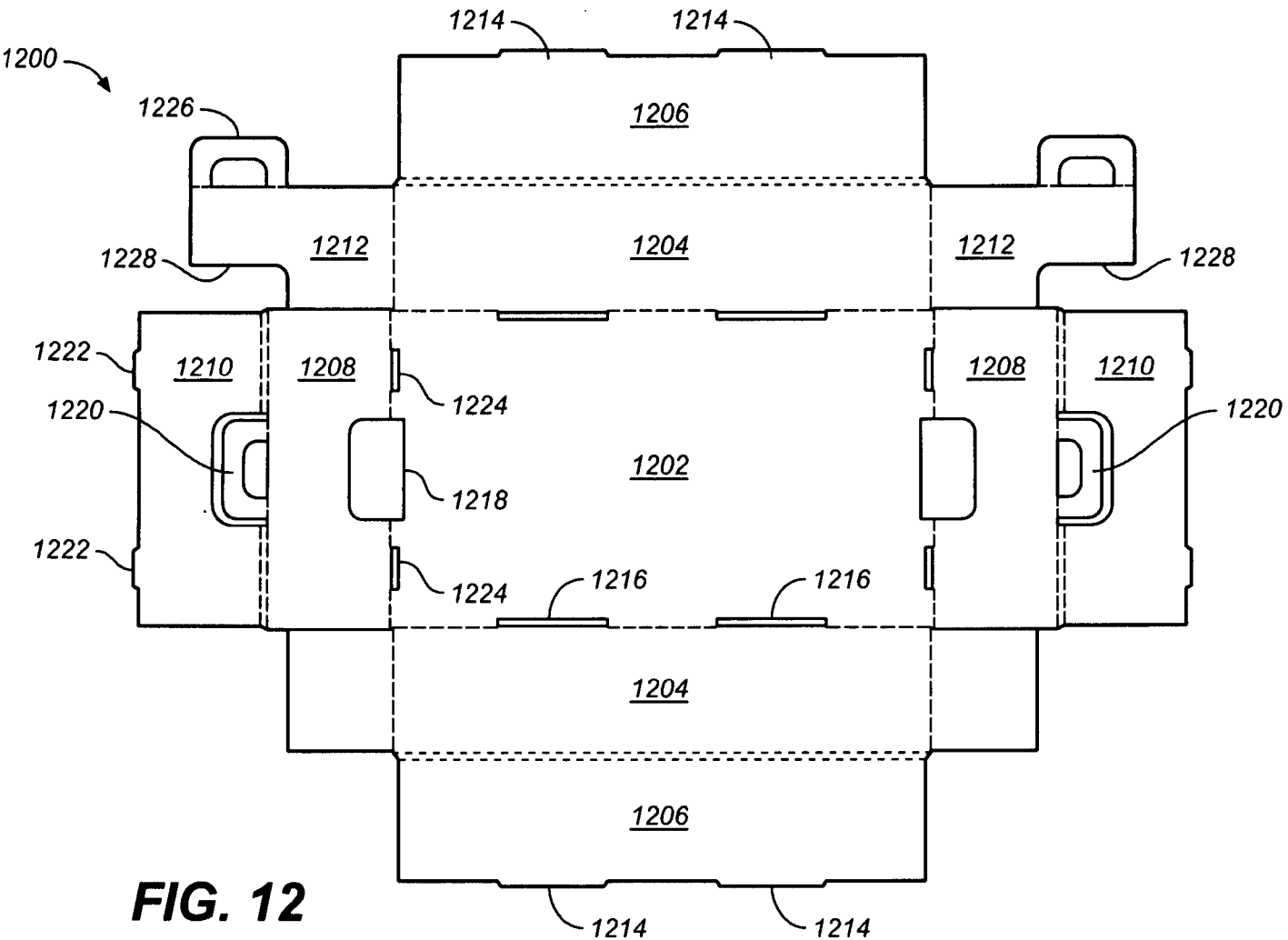
FIG. 12 is a tray storage container designed in accordance with one implementation of the present invention using a single sheet as illustrated.

A tray storage container 1200 designed in accordance with the present invention can be implemented using a single sheet as illustrated in FIG. 12. Tray storage container 1200 as illustrated has a rectangular tray base 1202, a pair of tray walls 1204, a pair of inner tray walls 1206, a pair of end tray walls 1208, a pair of inner end tray walls 1210 and a pair of back side tray walls 1212.

Rectangular tray base 1202 is connected along its length to front and back tray walls 1204. Each of the tray walls 1204 extend to inner tray walls 1206 along the same length of the rectangular tray base 1202. The inner tray walls 1206 each have at least one tray wall tab 1214 that fits into corresponding tray slots 1216.

End tray walls 1208 are connected along the width of rectangular tray base 1202. Each of the end tray walls 1208 includes a tray handle interlock 1218 formed by cutting out the area as indicated. Above tray handle interlock 1218 is an end tray handle 1220 that corresponds to the dimensions and size of the tray handle interlock 1218 cutout. If tray storage container 1200 is on the bottom of several other tray storage containers then tray handle interlock 1218 can be used as a convenient grab area for placing hands and lifting the one or more tray storage containers.

Scoring along the base of each end tray handle 1220 ensures that the handles can be folded downward to accommodate closing a box lid down flat across the top of tray storage container 1200. For example, closing the lid of a storage container 1102 in FIG. 11 should cause the handles of tray storage container 1200 to fold downward. It should be appreciated however that end tray handle 1220 maintain lateral rigidity orthogonal to the aforementioned scoring thus keeping a stack of several tray storage containers also from moving in this lateral direction.

Each of the end tray walls 1208 extend to inner end tray walls 1210 along the width of rectangular tray base 1202. End tray tabs 1222 located on the edge of each of the inner end tray walls 1210 fits into a corresponding end tray slots 1224. It should also be appreciated that the size of the cutout made for end tray handle can be enlarged in height such that it does not cover tray handle interlock 1218 cutout when folded downward and inward towards end tray slots 1224. Consequently, an assembled version of tray container 1200 allows cover tray handle interlock 1218 to not only function to receive other tray handles but also has a sufficient opening for placing hands and fingers to securely carry a stack of tray storage containers 1200. For example, the area in tray handle interlock 1218 that also operates as a grab area for fingers and hands also appears in FIG. 10 as tray grab area 1012. It is contemplated that tray grab area 1012 shall also be designed to line up with storage container grab area 747 in FIG. 7 as well as storage container grab area 147 in FIG. 2A. This allows the fingers to pass thru both the storage container 1000 and tray storage container 1008 allowing for easier and safer carrying of fruit goods or other food stuffs.

Back side tray walls 1212 are formed with a side tray handle 1226 as reinforcement to each of the end tray handles 1220. These side tray walls 1212 also have a notched area 1228 that fits around tray handle interlock 1218 thus providing sufficient clearance for positioning tray handles from other tray storage containers stacked from below.

Figure 13:
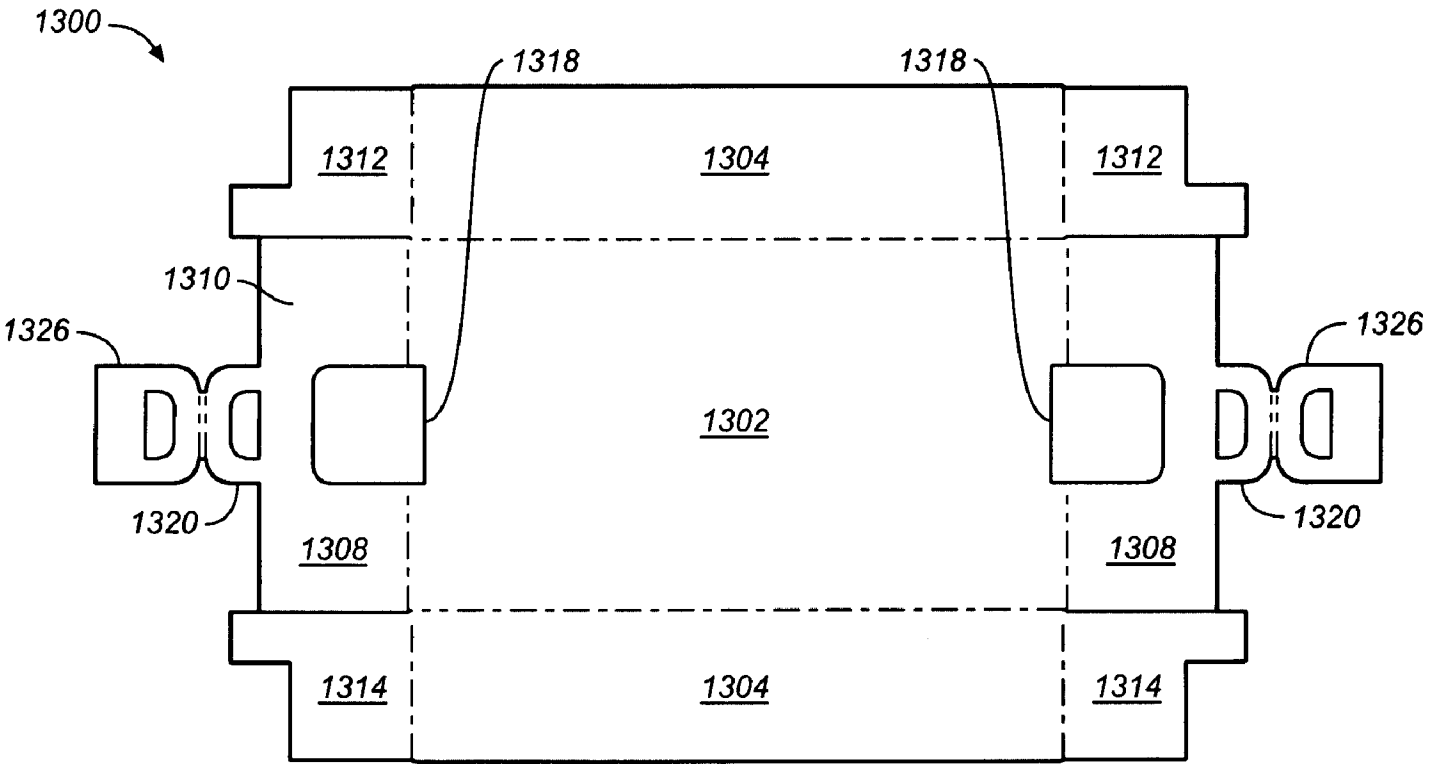
FIG. 13 is an alternative implementation of a glued tray storage container assembled using adhesive materials in addition to folds.

FIG. 13 is an alternative implementation of a glued tray storage container 1300 assembled using adhesive materials in addition to folds. The use of glue improves the overall strength of the assembled container and allows more flexibility in design choices. Like the folded version, glued tray storage container 1300 also can be implemented using a single cardboard sheet having a rectangular base 1302, a pair of tray walls 1304, a pair of end tray walls 1308, a pair of back side tray panels 1312 and a pair of front side panels 1314.

Rectangular tray base 1302 is connected along its length to front and back tray walls 1304. End tray walls 1308 are connected along the width of rectangular tray base 1302. Each of the end tray walls 1308 includes a tray handle interlock 1318 formed by cutting out the area as indicated. Above tray handle interlock 1318 is an end tray handle 1320 that corresponds to the dimensions and size of the tray handle interlock 1318 cutout. An extension tray handle 1326 to end tray handle 1320 acts as reinforcement to each of the end tray handles 1320. In one implementation, the size of tray handle interlock 1318 is large enough to accommodate extension tray handle 1326 when assembled and also provide additional clearance for fingers and hands for carrying. For example, if tray storage container 1200 is on the bottom of several other tray storage containers then tray handle interlock 1218 can be used as a convenient grab area for placing hands and lifting the one or more tray storage containers.

Scoring along the base of each end tray handle 1320 ensures that the handles can be folded downward to accommodate closing a box lid down flat across the top of tray storage container 1300. For example, closing the lid of a storage container 1102 in FIG. 11 should cause the handles of tray storage container 1300 to fold downward. It should be appreciated however that end tray handle 1320 maintain lateral rigidity orthogonal to the aforementioned scoring thus keeping a stack of several tray storage containers also from moving in this lateral direction.

As previously described, an assembled version of tray container 1300 allows cover tray handle interlock 1318 to not only function to receive other tray handles but also has a sufficient opening for placing hands and fingers to securely carry a stack of tray storage containers 1300. For example, the area in tray handle interlock 1318 that also operates as a grab area for fingers and hands also appears in FIG. 10 as tray grab area 1012. It is contemplated that tray grab area 1012 shall also be designed to line up with storage container grab area 747 in FIG. 7 as well as storage container grab area 147 in FIG. 2A. This allows the fingers to pass thru both the storage container 1000 and tray storage container 1008 allowing for easier and safer carrying of fruit goods or other food stuffs.

Back side tray walls 1312 are folded upward and inward to reinforce end tray walls 1308. Likewise, front side tray walls 1314 are also folded upward and inward upon assembly to provide a similar reinforcement. As previously described, it is contemplated that one skilled in the art provided at least FIG. 13 and other descriptions herein would be able to identify one or more locations for glue to assemble the glued tray storage container 1300 into a finished product that appears similar to tray storage container 800 in FIG. 8.

Figure 14:
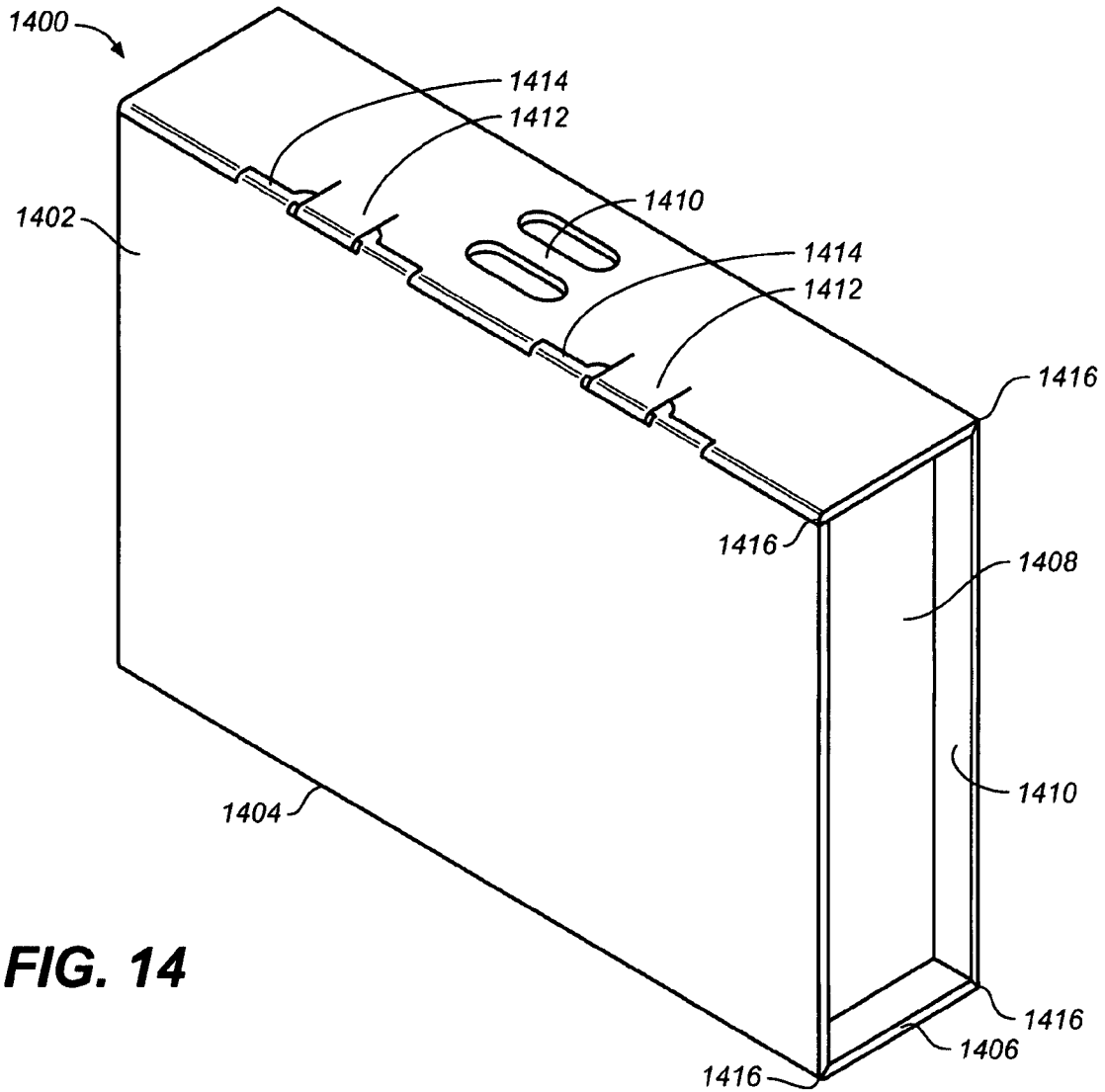
FIG. 14 illustrates a case storage container designed in accordance with yet another aspect of the present invention.

FIG. 14 illustrates a case storage container 1400 designed in accordance with yet another aspect of the present invention. This case storage container 1400 has a case storage container height 1402, a case storage container length 1404 and a case storage container width 1406. Characteristic of case storage container 1400, the case storage container width 1406 is approximately one-quarter to one-third the linear dimension compared with the case storage container height 1402. This gives case storage container 1400 a more streamlined appearance compared with storage container 300 in FIG. 3. As in the storage container 300 in FIG. 3, the case storage container 1400 includes an inset 1408 and an outer cover panel 1410. The closed case storage container 1400 in FIG. 14 illustrates outer cover panel 1410 secured in place by a pair of cover tuck flaps 1412 inserted into integral cover secure slots 1414. This also keeps case storage container 1400 closed and secure during shipping and handling.

A handle 1410 is placed along the top of case storage container 1400 running lengthwise and centered. This handle 1410 allows case storage container 1400 to be readily carried with one hand and without the risk of the case storage container 1400 inadvertently opening. Crush zones 1416 formed indirectly through creation of inset 1408 also protect fruit, vegetables or other food stuffs within case storage container 1400 from being damaged.

Figure 15:
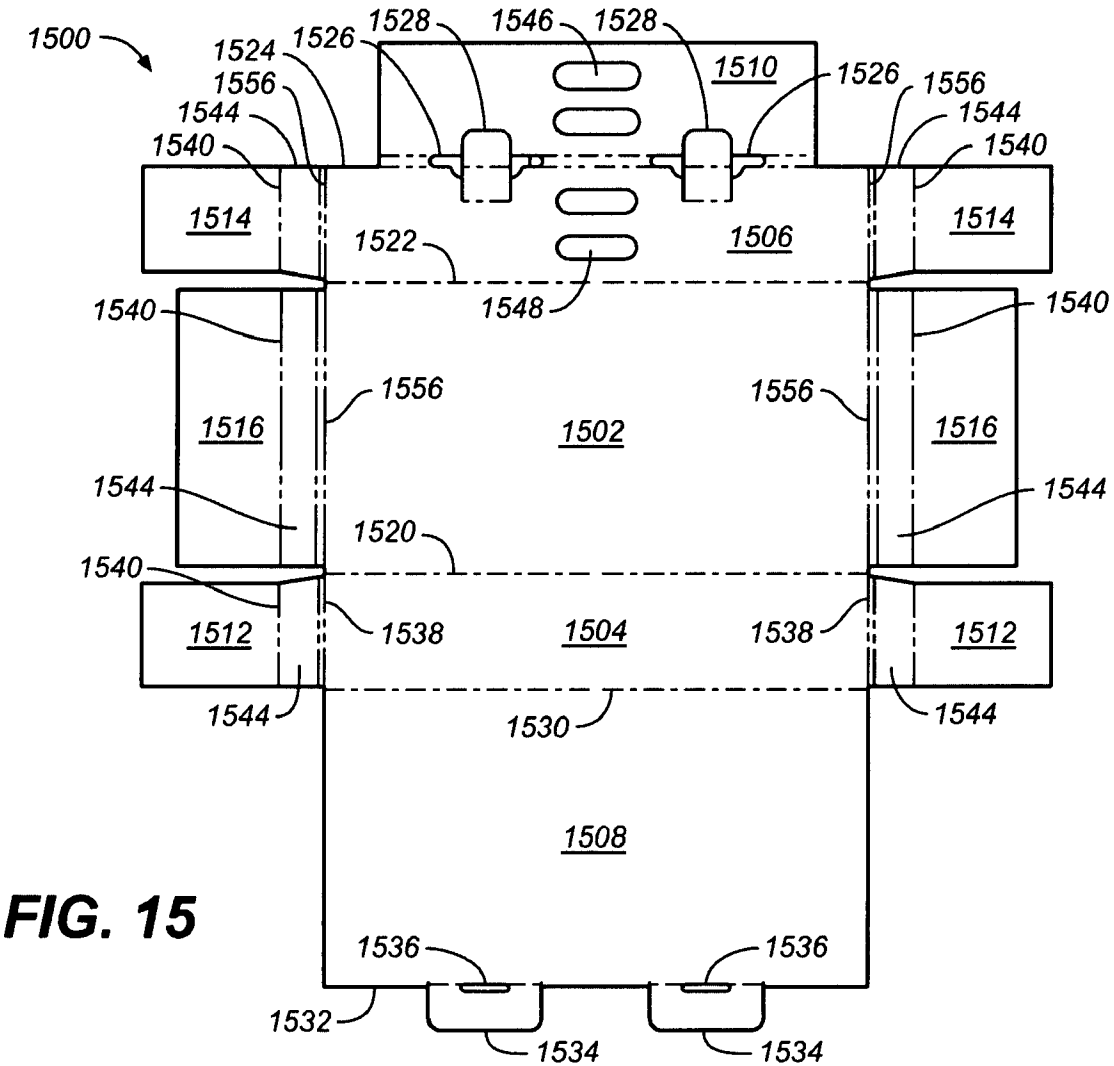
FIG. 15 illustrates a single sheet implementation of a glued case storage container in accordance with aspects of the present invention and assembled using adhesive materials in addition to folds.

FIG. 15 illustrates a single sheet implementation of a glued case storage container 1500 assembled using adhesive materials in addition to folds. Glued case storage container 1500 has a rectangular base 1502, a front wall 1504, a back wall 1506, an outer cover panel 1508, an inner cover panel 1510, a pair of front side panels 1512, a pair of back side panels 1514 and a pair of end walls 1516.

Rectangular base 1502 is connected to front wall 1504 by way of a fold along front edge 1520. Similarly, rectangular base 1502 is also connected to back wall 1506 by way of another fold along back edge 1522. At the top edge 1524 of back wall 1506 is at least one cover slot 1526 and integral cover secure flap 1528 that extends from within cover slot 1526. Inner cover panel 1510 extends from back wall 1506 along the folded top edge 1524. For example, the implementation depicted in FIG. 15 includes a pair of cover slots 1526 and a pair of integral cover secure flaps 1528 however greater or fewer slots and flaps can also be used. A first handle 1546 is cutout of inner cover panel and matches a second handle 1548 cutout from back wall 1506 as illustrated. Together the first handle 1546 folds inward and against a second handle 1548 form a stronger overall handle for carrying case storage container 1500 when filled with fruits, vegetables or other food stuffs.

Outer cover panel 1508 extends from front wall 1504 by way of a folded top edge 1530. Along the top edge 1532 of outer cover panel 1508 is at least one cover tuck flap 1534 and integral cover secure slot 1536 corresponding to the number of cover slots 1526 and integral cover secure flaps 1528 associated with back wall 1506. For example, a pair of cover tuck flaps 1534 and integral cover secure slots 1536 is matched with the pair of cover slots 1526 and integral cover secure flaps 1528 in the example implementation in FIG. 15.

Front side panels 1512 extend from side edges 1538 of front wall 1504 along a double-scored perforation to facilitate multiple flat folds of cardboard material. An additional scoring 1540 is on each front side panel 1512 forming an inset panel 1544.

Likewise, back side panels 1514 extend from side edges 1556 of back wall 1506 also along double-scored perforations. To also provide for inset panels 1544, additional scoring 1540 is made on back side panels 1514 as indicated.

Rectangular base 1502 also has a pair of end walls 1516 extending from side edge 1556 along double-scored perforations. It is contemplated that one skilled in the art provided at least FIG. 15 and other descriptions herein would be able to identify one or more locations for glue to assemble the glued storage container 1500 into a finished product that appears similar to case storage container 1400 in FIG. 14. Some of the many benefit of the glued case storage container 1500 compared with a folded version of a case storage container includes less required material, simpler assembly and potentially overall higher strength.

Figure 16:
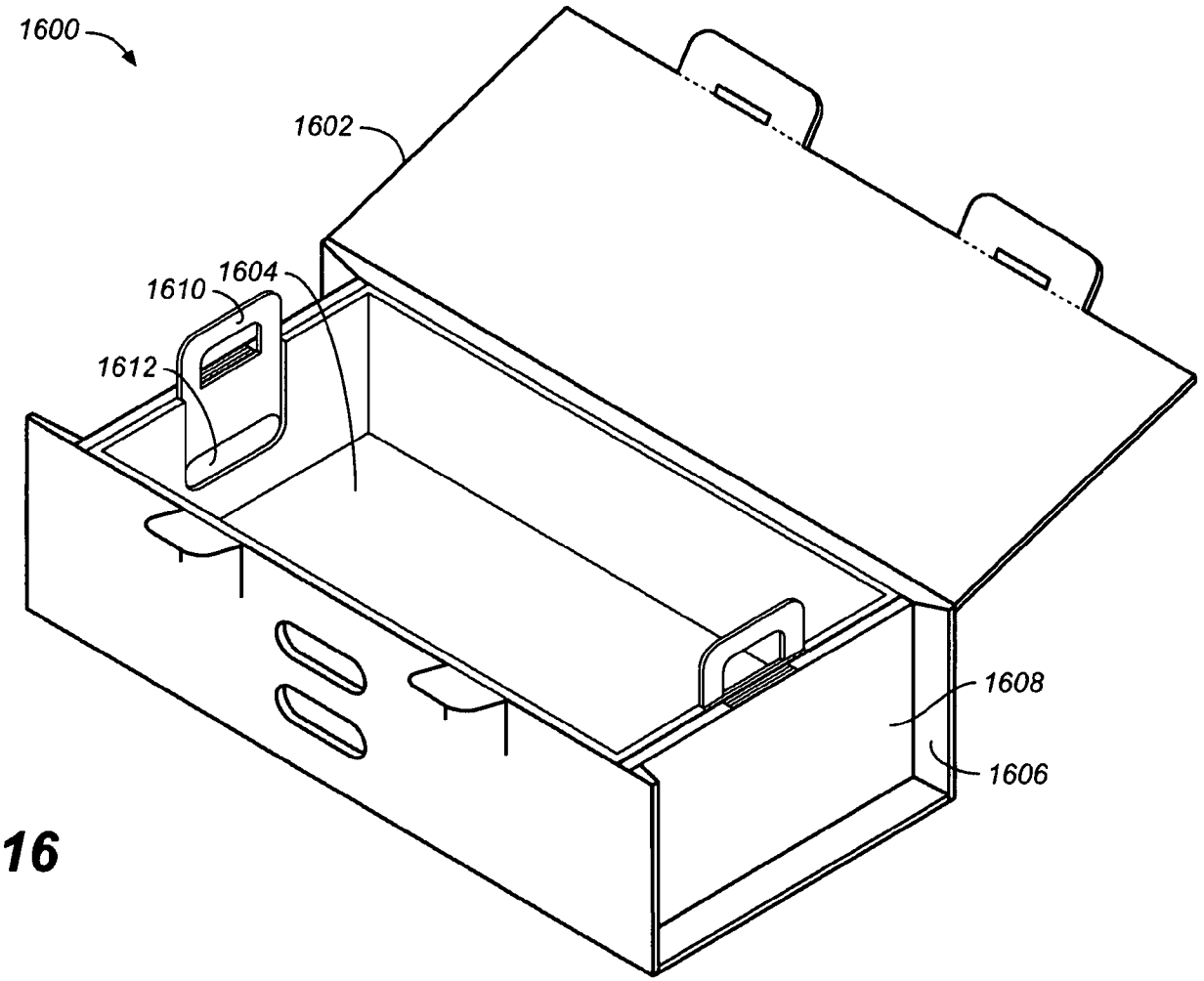
FIG. 16 illustrates an assembled case storage container having a tray storage container in accordance with one implementation of the present invention.

An assembled case storage container 1602 having a tray storage container 1604 is illustrated in FIG. 16. Case storage container 1606 includes an inset 1608 and handles (not visible) and is in an open state. The convenience of using both the tray storage container 1604 within the case storage container 1606 is exemplified in FIG. 16. For example, a person can carry a case storage container to an office in an upright position using the single handle. Given the design and strength of case storage container 1606, the person can carry a large amount of fruit or other food stuffs along with other items necessary for work such as a satchel or purse. Next, the person can then open the case storage container 1602 in a flat orientation as illustrated in FIG. 16. This exposes the tray storage container 1604 contained within along with any fruit or food stuffs that have been packaged. Handles 1610 are extended from a flattened position thus allowing the tray storage container 1604 to be lifted along with fruit to be displayed or shared with others in the office, home or other workplace. It is also possible to carry tray storage container 1604 through opening in tray handle interlock 1612 as indicated.

While specific embodiments have been described herein for purposes of illustration, various modifications may be made without departing from the spirit and scope of the invention. Accordingly, the invention is not limited to the above-described implementations, but instead is defined by the appended claims in light of their full scope of equivalents.

What is claimed is:

1. A storage container formed from cardboard material, comprising:

a rectangular base unit having a front wall with a wall width and wall length folded upwardly along a folded front edge of the rectangular base, a back wall having the wall width and the wall length folded upwardly along a folded back edge of the rectangular base;

an outer cover panel extension to the front wall having a cover width and a cover length folded in a spaced and parallel relationship to the rectangular base along a folded top edge of the front wall wherein each edge along the cover width has a cutout in a smooth shape to increase ergonomics and usability;

front side panels each extending laterally and inwardly along a scored side edge of the front wall;

back side panels each extending laterally and inwardly along a scored side edge of the back wall; and end walls each extending upwardly along scored side edges of the rectangular base having a grab area in each end wall allowing fingers from a hand to be placed into the grab area and extend upwards towards the outer cover panel while passing over the smooth shape along the width of the outer cover having the cutout.

2. The storage container of claim 1 wherein the back wall includes at least one cover slot and integral cover secure flap extending from within the at least one cover slot to secure the outer cover panel.

3. The storage container of claim 1 wherein the outer cover panel extension further includes at least one cover tuck flap with an integral cover secure slot both cooperating with the at least one cover slot and integral cover secure flap respectively to secure the outer cover panel.

4. The storage container of claim 1 wherein the grab area in each side of the pair of end walls are formed from a shape selected from a set of shapes including an elliptical shape, a rectangular shape and a trapezoidal shape.

5. The storage container of claim 1 further comprising an inner cover panel extension to the back wall having the cover width and the cover length folded along a folded top edge of the back wall in a spaced and parallel relationship to the rectangular base and directly under the outer cover panel wherein each edge of along the cover width of the inner cover panel extension has a cutout in a smooth shape to increase ergonomics and usability.

6. The storage container of claim 1 wherein the smooth shape is selected from a set of shapes including sickle, crescent, trapezoidal, circular and elliptical.

7. The storage container of claim 1 wherein the end walls are attached to the front side panels and the back side panels using an adhesive material.

8. The storage container of claim 1 wherein the end walls further include a pair of side tab slots designed to receive side panels tabs located on the top edge of each of the front side panels and side panel tabs located on the top edge of each of the back side panels thereby attaching the pair of end walls to the front side panels and back side panels.

9. The storage container of claim 1 further comprising an inset formed by each of the end walls resulting in at least one crush corner to protect contents of the case storage container from various forces applied to the case storage container.

10. The storage container in claim 1 wherein the wall width is substantially the same linear dimension compared with the cover width.

11. The storage container in claim 1 wherein the wall width is sufficiently wide to accommodate at least two layers of fruits.

12. The storage container in claim 1 further including at least one tray storage container inside of the storage container wherein the at least one tray storage container has at least a pair of foldable handles and capable of holding a variety of fruits arranged in a single layer.

* * * * *